US005140507A

United States Patent [19]

Harwood

[11] Patent Number: 5,140,507

[45] Date of Patent: Aug. 18, 1992

[54] ADJUSTABLE LIGHTING SYSTEM

[76] Inventor: Ronald P. Harwood, 31110 Applewood, Farmington Hills, Mich. 48018

[21] Appl. No.: 662,430

[22] Filed: Feb. 28, 1991

Related U.S. Application Data

[63] Continuation-in-part of Ser. No. 529,090, May 24, 1990, abandoned.

[51] Int. Cl.[5] ..... F21V 21/14

[52] U.S. Cl. ..... 362/271; 362/275; 362/287; 362/419; 362/428; 248/278; 403/55; 74/479

[58] Field of Search ..... 362/233, 271, 272, 273, 362/275, 286, 287, 289, 418, 419, 427, 428, 404, 147; 248/278; 403/55, 59; 74/479

[56] References Cited

U.S. PATENT DOCUMENTS

| | | | |
|---|---|---|---|
| 4,112,486 | 9/1978 | Tovi | 362/275 |
| 4,488,209 | 12/1984 | Gosswiller | 362/419 |
| 4,598,345 | 7/1986 | Kleeman | 362/272 |
| 4,656,398 | 4/1987 | Michael et al. | 362/404 |
| 4,688,154 | 8/1987 | Nilssen | 362/404 |
| 4,727,460 | 2/1988 | Payne | 362/275 |
| 4,760,507 | 6/1988 | Lasker et al. | 362/275 |
| 4,814,955 | 3/1989 | Price | 362/419 |
| 4,890,207 | 12/1989 | Jones | 362/419 |
| 4,931,917 | 6/1990 | Scherf et al. | 362/275 |

*Primary Examiner*—Richard R. Cole
*Attorney, Agent, or Firm*—Dykema Gossett

[57] ABSTRACT

An adjustable lighting fixture having a power transfer means, such as a gearbox, interposed between the lamp holder, such as a gimbal ring, and the point of mounting, the output shaft of the gear box connected directly to the lamp holder to rotate the same about a first axis upon rotation of the input shaft of the gearbox, and the housing of the gear box being connected to the point of mounting to rotate the same about a second axis upon rotation of the housing, thereby providing for rotation of the lamp holder so mounted about two different axis from a remote location.

55 Claims, 8 Drawing Sheets

ADJUSTABLE LIGHTING SYSTEM

BACKGROUND OF THE INVENTION

The present application is a continuation-in-part of co-pending patent application Ser. No. 07/529,090 filed May 24, 1990, for Adjustable Lighting System now abandoned.

The present invention relates to lighting systems, and more particularly to lighting systems of the type generally employing spotlights or track lights mounted some distance away from the object which they are intended to illuminate, such as near the ceiling of a retail establishment. However, the present invention can be used with any luminaire requiring adjustment.

DESCRIPTION OF THE PRIOR ART

Lighting systems employing spotlights have been used in the art for many years as a convenient means of focusing a large of amount of light on an object. They have been used in various fields, such as in stage plays, to focus lights on the performers, and in retail establishments to focus light on objects being highlighted on display. Although the present invention is usable in many fields, for ease of explanation, its relationship to the prior art will be explained from the point of lighting systems used to highlight merchandise in large retailing establishments.

Practically no matter how such prior art systems were used in retailing establishments, they presented serious problems in the art. If used on the sales floor of such retailing establishments to highlight merchandise, they would typically be mounted near the ceiling of such retail establishments, which are much higher than ceilings found in the home, for example. While they were trouble-free in operation, problems arose as soon as the retail floor was rearranged, and the need to adjust the spotlights used in such systems came into being. The most obvious of these problems involves the safety of the store personnel who are to adjust the spotlights. Such adjustment normally requires that the store personnel climb on top of very tall ladders, raising the possibility of injury from falls and the like. Additionally, there was an electrical hazard involved with such adjustments, and the possibility of electrical shock arose unless the spotlights were turned off while they were being adjusted. This presented the problem of how to adjust the spotlights during normal business hours, and required either that they be adjusted after hours, or that merchandise be sold without the normal highlighting, thus affecting the sales of the retail establishment. In the lighting system of the present invention, all these problems are largely eliminated, as the luminaires used in the system can easily be adjusted while the system is in operation.

Additionally, merchandise right under the spotlights, or near the fixtures to be adjusted, had to either be moved, or great difficulty was presented getting a ladder in position to adjust them. Also, the possibility of burns would be presented if the spotlights were not turned off and given sufficient time to cool before attempting to adjust them.

As difficult as adjusting the spotlights was, they were found to be such an aid to retailing that the difficulties would be accommodated each time merchandise was moved because spotlights which were not adjusted properly were a waste of electrical energy, and created useless heat as well as detracting from the sale of merchandise.

Another serious problem arises where the spotlights are used in store windows to highlight a mannequin. In contrast to the problem presented when spotlights are used on the sales floor of large retailing establishments, the use of the spotlight to highlight a mannequin in the store window presents the same problems, but for the opposite reasons. Usually, when highlighting mannequins, the spotlights are located in very cramped quarters, where even a regular-size ladder presents problems, as it may not easily fit into the space occupied by the mannequin.

Even if the ladder can be positioned in the store window or other location where the mannequin is located, there is a very cramped space for the operator to work, making the possibility of electrical shock or burn no less than when the fixture is installed at or near the ceiling of a retail establishment and, in fact, increases the problem.

In view of the problems in the present art, attempts have been made to provide for adjustment of lighting fixtures without touching the fixtures themselves. For example, various models of spotlights made by Capri Lighting, such as the KR851 Pyramid Spotlight and others, have an adjustment knob spaced from the housing which may be rotated to rotate the spotlight. However, one must still reach the knob either in the cramped space provided in the store window or at great heights such as in the retail establishment, and so very little advantage is provided by this knob in the view of the hazards presented since the problems of reaching the fixture and coping with the heat and electrical problems are not eliminated by the mere providing of an adjustment knob.

As longstanding as these problems have been in the retailing industry, there has been no satisfactory solution until the time of the present invention.

SUMMARY OF THE INVENTION

In order to largely eliminate the problems present in the prior art, I have provided a lighting system employing a lighting fixture which, when used in a retail establishment, is adaptable for use as a spot light or track light. This system provides an adjustment means connectable to a power transfer means which is interposed between the fixture mounting pole, whether mounted to a canopy or a standard track head and the luminaire to be adjusted. The system further provides a power transfer means mounted to a rotatable fixture mounting pole which, by virtue of having its housing mounted to the pole, provides for rotation about the axis of the pole when the housing is physically turned by a remote adjustment wand. Alternately, the pole may remain stationary, and the housing may rotate.

Rotation about a second axis is possible by attaching the lighting fixture itself to the output shaft of the power transfer means. By the use of a hollow adjustment wand, the outside of which is adapted to physically rotate the housing, and the inside of which rotates the input shaft of the power transfer means and thus, also the output shaft attached to the lighting fixture, rotation of the spotlights about two different axes from a remote location is provided for.

In a modification of the invention, the position of the power transfer means is reversed. The power transfer means is mounted on the end of the hollow adjustment wand, instead of being mounted at the end of the fixture mounting pole. In this embodiment, a physical rotation of the hollow adjustment wand will still physically rotate the housing about a first axis, and a rotation of the inside of the hollow adjustment wand will rotate the output shaft of the power transfer means, which is attached to a connector drivingly connected to the lighting fixture, for rotation about a second axis.

In a further modification of the present invention, the power transfer means is split between the hollow adjustment wand and the end of the fixture mounting pole to provide for rotation of the light fixture about two axes of rotation. In all cases, a power input about a single axis of rotation provides for rotation of a light source or luminare about two axes of rotation.

The result of any of the different forms of the invention is a lighting fixture which can easily be adjusted from the sales floor of a retailing establishment when a light is mounted at or near the ceiling, without the movement of any merchandise, and a lighting fixture which is just as easily adjusted when used in a cramped location.

Thus, one of the objects of the present invention is to provide a lighting fixture mountable in a wide variety of locations which may be rotated about two different axis planes from a remote location.

A further object of the present invention is to provide a lighting fixture usable in track lighting systems commonly found in large retailing establishments which may be adjusted from the sales floor of such establishments, even though the track light is mounted at or near the ceiling in such stores.

A still further object of the present invention is to provide a track lighting fixture which may be easily adjusted while in operation without presenting an electrical hazard to the adjusting personnel.

Another object of the invention is to provide a track lighting fixture which may easily be adjusted from a remote location without presenting any burn hazard to the adjusting personnel.

Another object of the present invention is to provide for an adjustable track lighting fixture which may be adjusted without the need for ladders and the like.

Another object of the present invention is to provide for a lighting fixture which may be adjusted without disruption of the retail environment during business hours.

A still further object of the present invention is to provide for an adjustable lighting fixture which may be adjusted without presenting any danger to customers.

A still further object of the present invention is to provide a lighting fixture of the foregoing nature which is adaptable to a wide variety of uses.

Another object of the present invention is to provide a lighting fixture having an interchangeability of components so that several types of lighting fixtures may be interchangeably mounted to the rotating means.

A still further object of the present invention is to provide an adjustable lighting fixture of a modular nature.

A still further object of the present invention is to provide a method of converting existing track lighting fixtures to track lighting fixtures adjustable about two different axes from a remote location.

Further objects and advantages of the present invention will be apparent from the following description and appended claims, reference being made to the accompanying drawings forming a part of the specification, wherein like reference characters designate corresponding parts in the several views.

It is to be understood that the present invention is not limited to the detail of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DETAILED DESCRIPTION OF THE PREFERRED EMBODIMENTS

It should be understood that the scope of the present invention is very broad. The lighting system disclosed herein is usable anywhere an adjustable lighting fixture is desired, and not just in display windows or in retail establishments. For ease of understanding, my invention will be described in an embodiment wherein my adjustable lighting fixture is used as a track light mountable through a track head to a conventional lighting track of the type used in retail establishments. Even in regard to this embodiment, however, it should be understood that a track head is not essential, and the fixture mounting pole to be described can be mounted directly to a canopy, if desired.

Figure 1:
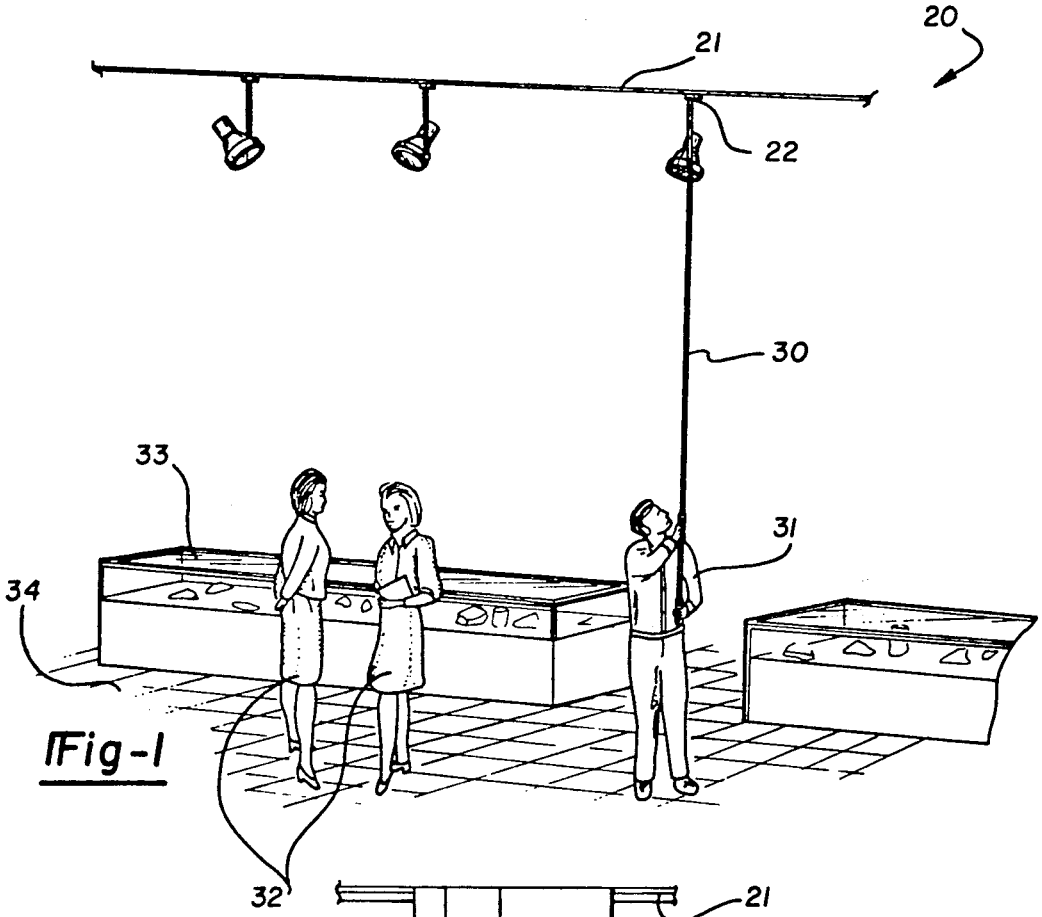
FIG. 1 is a pictorial view showing a construction embodying the present invention installed in a retailing establishment.
Figure 2:
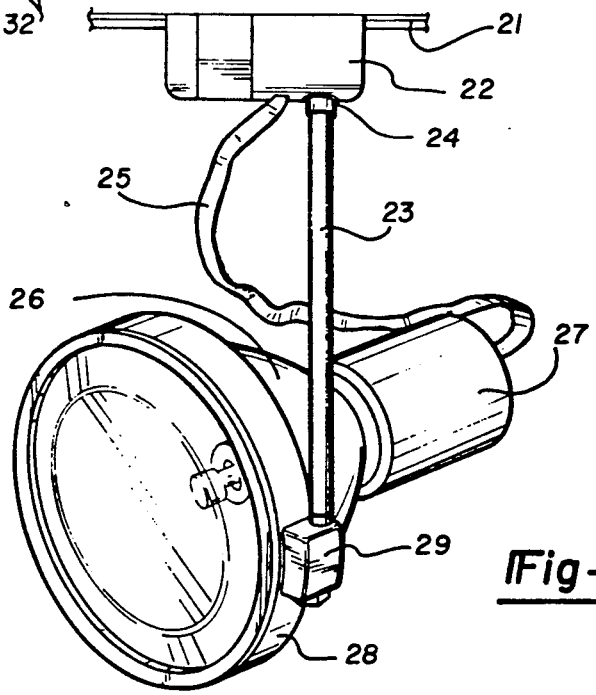
FIG. 2 is an enlarged perspective view of one of the lighting fixtures shown in FIG. 1.
Figure 15:
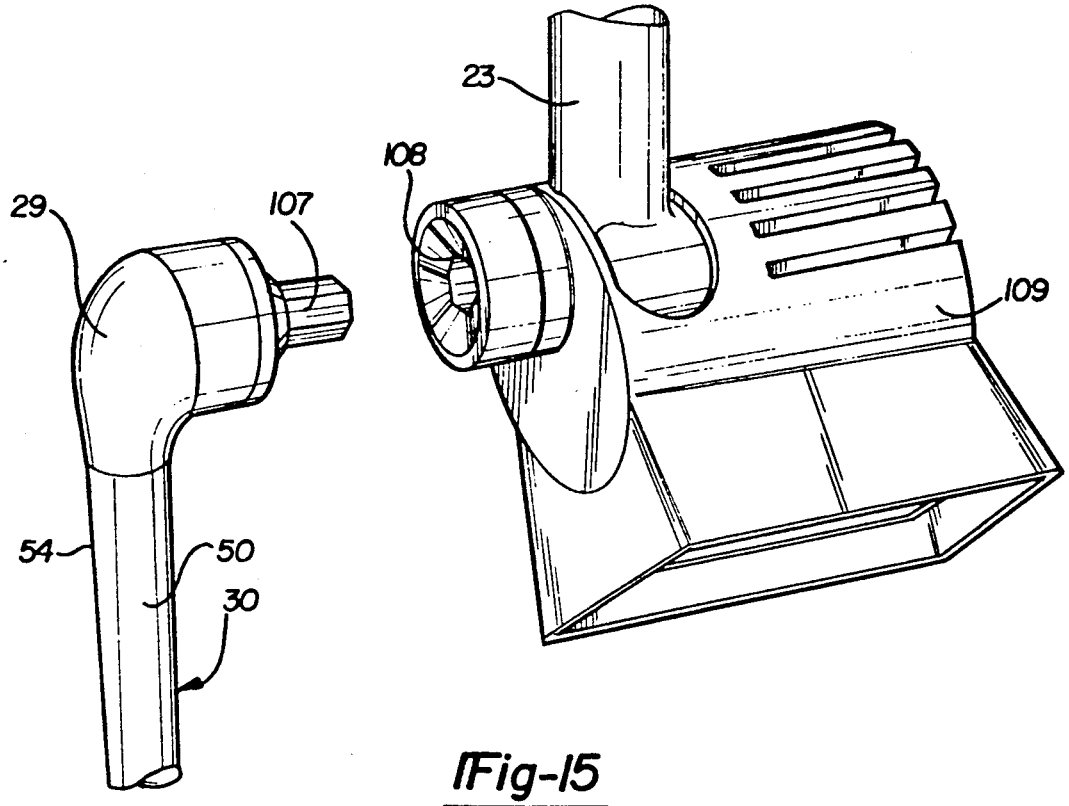
FIG. 15 is a modification of the present invention, wherein the power transfer means are placed at the end of the hollow adjusting wand.
Figure 17:
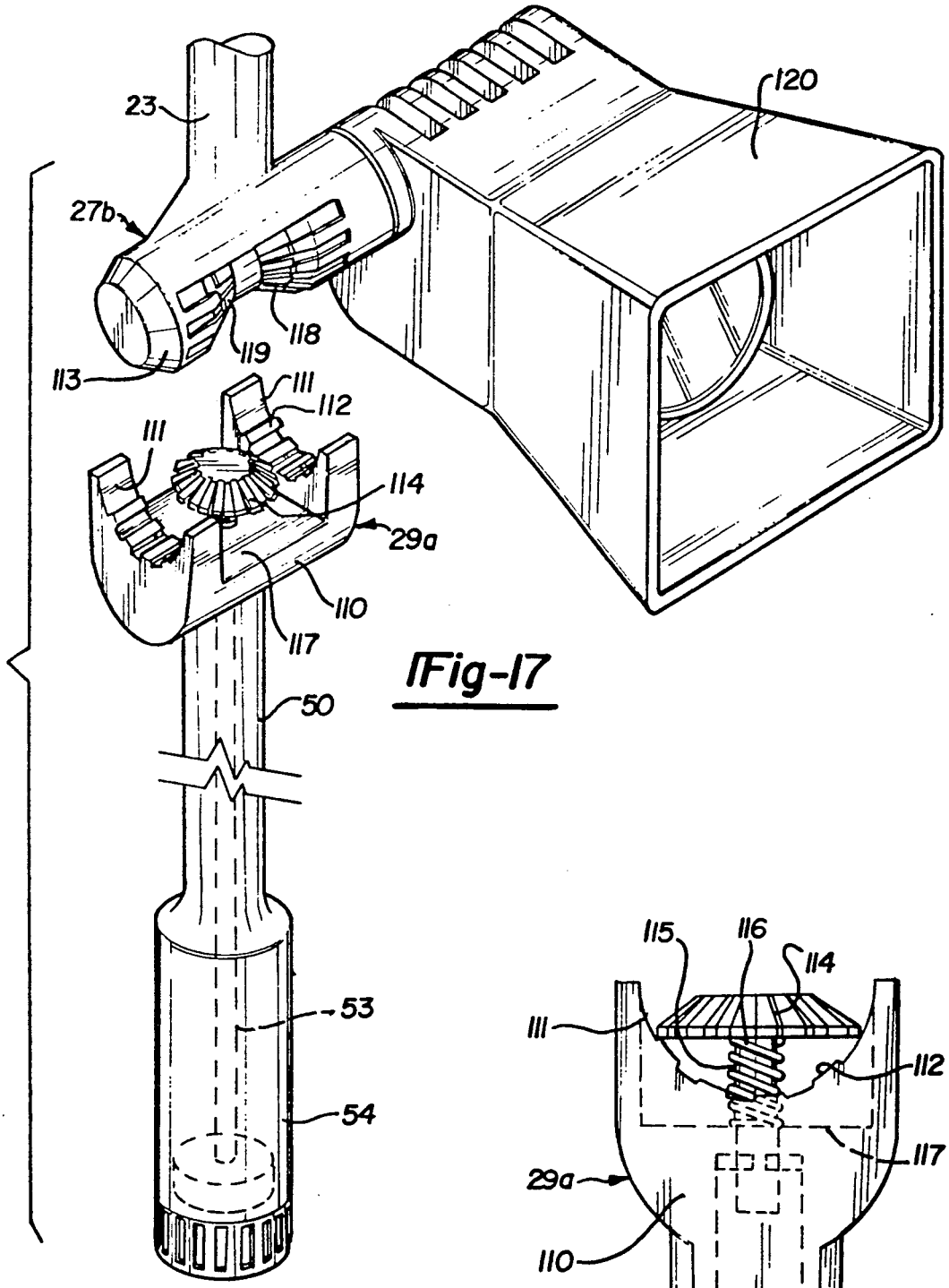
FIG. 17 is a perspective view of a modification of the present invention, employing the power transfer means shown in FIG. 16.

Referring now to FIGS. 1 and 2, the invention is shown embodied in a track lighting system generally designated by the numeral 20, wherein a lighting track 21 supplies power to a track head 22 to which is rotatably mounted a fixture mounting pole 23. If desired, a manual tensioning ring 24 may be added as is well known in the prior art. Power is supplied from the track head 22 through the power cord 25 to the socket 27 in which is mounted a lamp 26 which is held in a lamp holder, such as gimbal ring 28. It should be understood that each different lamp which is used in the improved lighting fixture of the present invention may require a different "lamp holder". Therefore, this term should be understood in a generic sense to mean any apparatus which is attached to the power transfer means and provides a source of light, whether it is something as simple or simpler than that illustrated in FIGS. 1 and 3, or a complete luminaire, as illustrated in FIGS. 15 and 17. For purposes of illustration only, I have shown the gimbal ring 28. Power can also be supplied through the fixture pole 23, also known in the art as a stem or wand.

The gimbal ring 28 is mounted to the power transfer means 29 in a manner to be more completely described hereinafter. By mounting the power transfer means 29 between the gimbal ring 28 and the fixture mounting pole 23, the light is rotatable about two different axes of rotation in response to a power output about one of said axes only.

As shown in FIG. 1, an adjustment means 30 may be used to adjust some, or all of the fixtures in the track lighting system. This may be done by maintenance personnel 31 without disturbing any of the display counters 33 on the selling floor 34 of the retail establishment. The customers 32 also remain undisturbed while the fixtures are adjusted by the maintenance personnel without any electical or burn hazard being presented during the adjustment process.

Figure 3:
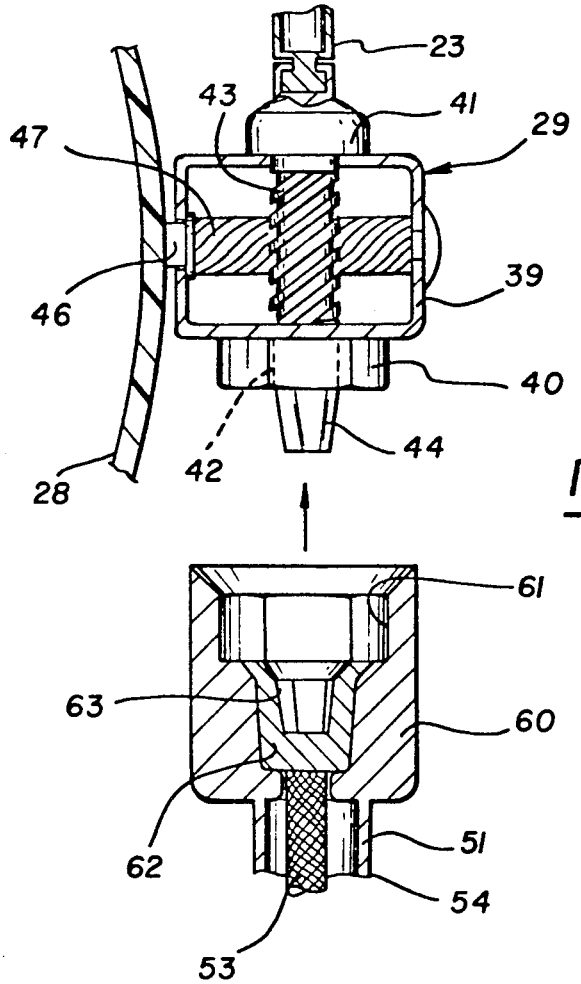
FIG. 3 is a view, partly in section, showing an adjustment means of the present invention which provides for rotation of the lighting fixture about two different axes.
Figure 4:
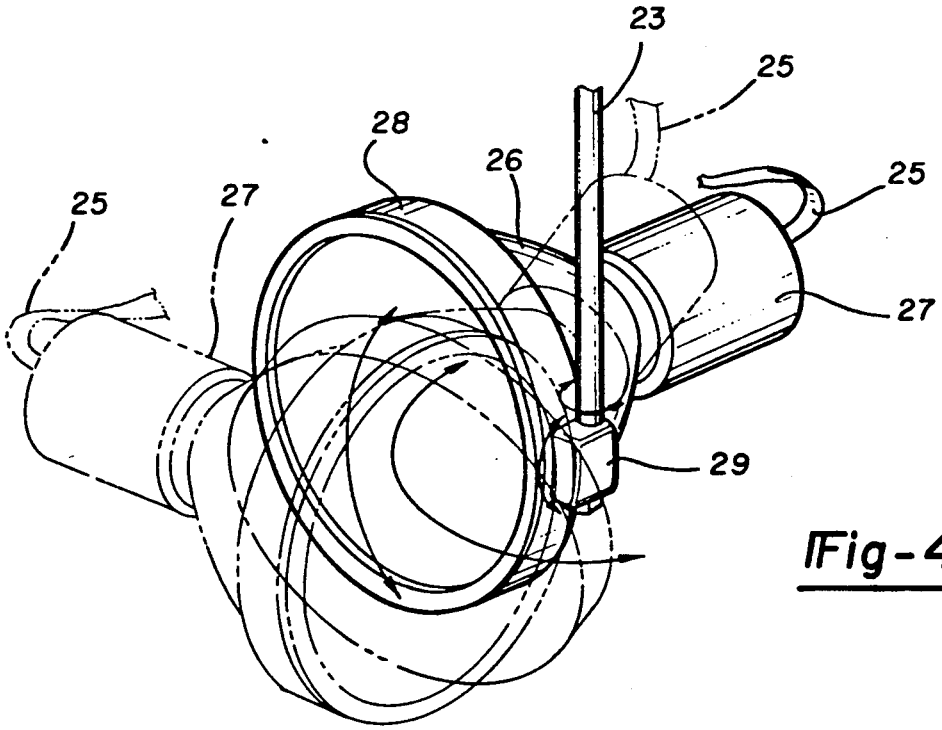
FIG. 4 is a pictorial view showing a portion of the wide variety of adjustments possible in the improved lighting fixture embodying the present invention.

Referring now to FIGS. 3 and 4, there is shown one of the embodiments of the present invention. As shown in FIG. 3, a power transfer means generally designated by the numeral 29 includes a housing portion 39 having a male connector portion 40 formed on the lower end thereof.

It is to be understood that the term power transfer means is used in its broad sense to indicate a transfer of power from one direction to another. While in the this embodiment of the invention the power transfer means is illustrated as a gear box which has an input shaft geared to an output shaft at right angles thereto, the power transfer elements can be other than gears, and the power transfer can take place from one axis to any intersecting axis to have the output shaft of the power transfer means form any practicable angle with the input shaft to give the widest possible variety of options for positioning my improved invention. Also, the power transfer means may be mounted at the end of the adjustment means 30 instead of on the fixture pole 23 as will be hereinafter described. In the most preferred embodiment of the invention, the power transfer means will be split between the adjustment means 30 and the end of the fixture mounting pole 23.

Passing through the male connector portion 40 of the housing 39 and rotatably constrained therein is an input shaft 42 having a first worm gear 43 formed thereon and having a male connector 44 formed on the lower end thereof. Also mounted for rotation within the housing 39 is an output shaft 46 fixedly attached to the gimbal ring 28 and having a second worm gear 47 provided therein. It can be seen that when the input shaft 42 is rotated, the output shaft 46, and therefore the gimbal ring 28, will rotate about the axis of rotation of the output shaft 46, and that when the fixture mounting pole 23, and/or the housing 39 is rotated, the gimbal ring will rotate about the axis of the fixture mounting pole 23.

It should be understood that while I have shown the input shaft and the output shaft being perpendicular to each other, depending upon the desired application, such shafts can be provided at any practicable desired angle to each other to provide rotation about two different axis as desired. Also, while I have assumed for the purposes of description that a conventional track light already has a rotatable mounting pole 23, it is anticipated that in some instances the fixture mounting pole 23 will be fixed to the track head 22, in which case the power transfer means 29 will then need to be rotatably mounted to the fixture mounting pole 23. This is also well within the scope of the present invention.

Also, while I have shown the use of a gimble ring for mounting a light fixture in the embodiment of the invention shown in FIGS. 3 and 4, as will be described in relation to the most preferred embodiment of the invention, the lighting fixture itself, or a portion thereof, may be attached to or be integral with the output shaft of the power transfer means 29, and this is well within the scope of the present invention.

Figure 7:
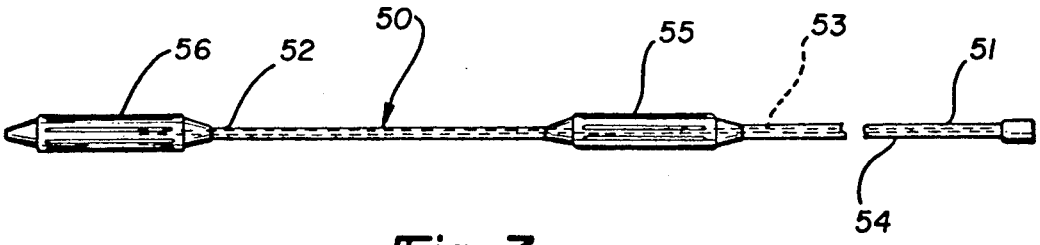
FIG. 7 is an elevational view showing a modification of the adjustment means used in the present invention.

Referring now to FIGS. 3 and 7, the adjustment means 30 is shown in the form of a wand generally designated by the numeral 50 having an upper end 51 and a lower end 52 and having an inner driving portion 53 and an outer driving portion 54.

Figure 8:
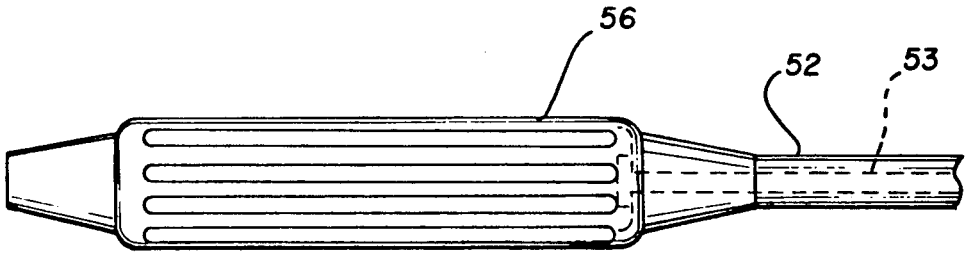
FIG. 8 is an enlarged elevational view of a portion of the adjustment means shown in FIG. 7.
Figure 9:
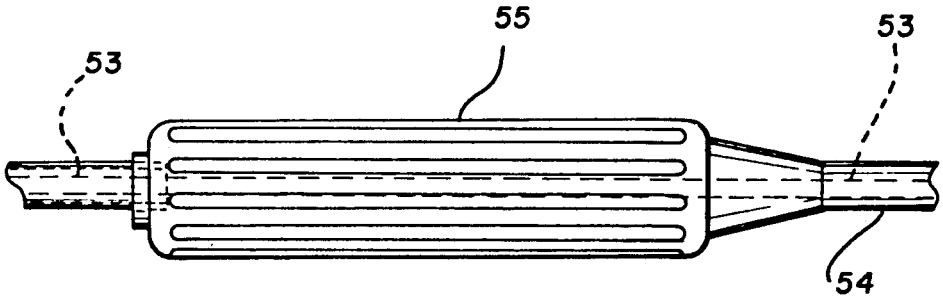
FIG. 9 is an enlarged elevational view showing another portion of the apparatus shown in FIG. 7.

As can be seen by referring to FIGS. 7-9, affixed to the outer driving portion 54 at approximately the midpoint of the wand 50 is an upper handle 55, while at the lower end 52 of the wand 50 there is a lower rotatable handle 56 fixedly mounted to the inner driving portion 53.

Referring again to FIG. 3, it can be seen that at the upper end 51 of the wand 50 there is a first socket 60 fixedly mounted to the outer driving portion 54 of the wand which has a female connector portion 61 formed therein for engagement with the male connector portion 40 of the housing 39.

Rotatably mounted within the first socket 60 is a second socket 62 attached to the inner driving portion 53 of the wand 50 and having a female connector 63 formed therein for engagement with the male connector 44 formed on the lower portion of the input shaft 42. It can be seen that when the lower rotatable handle 56 is rotated while the upper handle 55 is held stationary, only the second socket 62 and therefore the input shaft 42 of the power transfer means rotates, rotating the gimbal ring 28 in a plane which is defined by the ring, and which rotates about the axis of the output shaft 46.

If the lighting axis of the lamp 26 held by the gimbal ring 28 is satisfactory, such lighting axis being through the center of and perpendicular to the plane defined by the gimbal ring, and it is not desired to rotate the gimbal ring, the lower rotatable handle 56 may be held stationary with respect to the upper handle 55, i.e. rotated with the same angular frequency or be constrained to rotate at the same angular frequency with the upper handle 55, in which case the second socket 62 will not rotate with respect to the outer socket 60 so that the drive shaft 42 will not rotate, but the gear box housing 39 will rotate by virtue of its being fixedly connected to the male connector portion 40, thus rotating the gimbal ring about the axis of the fixture mounting pole 23.

In the example shown, the axis of the output shaft 46 about which the gimbal ring rotates, and the axis of the fixture mounting pole 23, are shown to be mutually perpendicular to each other. As hereinbefore mentioned, however, this mutually perpendicular relationship, while being the preferred embodiment, is not the only embodiment possible, and it is well within the scope of the present invention that the two axes of rotation can be at any practicable angle to each other, depending on the particular application desired.

Figure 6:
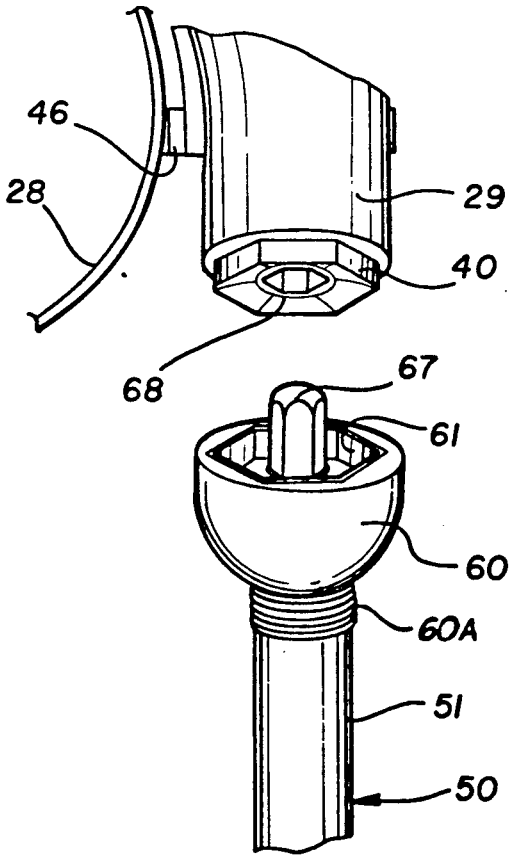
FIG. 6 is similar in part to FIG. 3, showing a modification of the adjustment means of my invention.

Referring now to FIG. 6, there is shown a modification of the upper end of the wand which has proven desirable when the lighting fixture of the present invention must be adjusted from a great height. In this case, at the upper end 51 of the wand 50, the first socket 60 with the female connector portion 61 is identical to that shown in FIG. 3. However, the male and female connections of the input shaft 42 of the power transfer means 29 are reversed. In this instance, a male connector 67 is fixedly attached to the inner driving portion 52 of the wand 50 and engages a female connector 68 provided at the lower end of said input shaft 42. If desired, the male connector 67 may be spring-loaded for ease of attachment. As before, rotation of the inner driving portion 53 of the wand 50 rotates the gimbal ring 28 in a plane of rotation defined by the ring, which intersects the axis of the output shaft 46, while rotation of the outer driving portion 54 of the wand 50 rotates the gimbal ring in a plane of rotation about the axis of the fixture mounting pole 23. Below the first socket 60 is a flexible joint 60A to allow for ease of engagement by not requiring 0° alignment.

Figure 5:
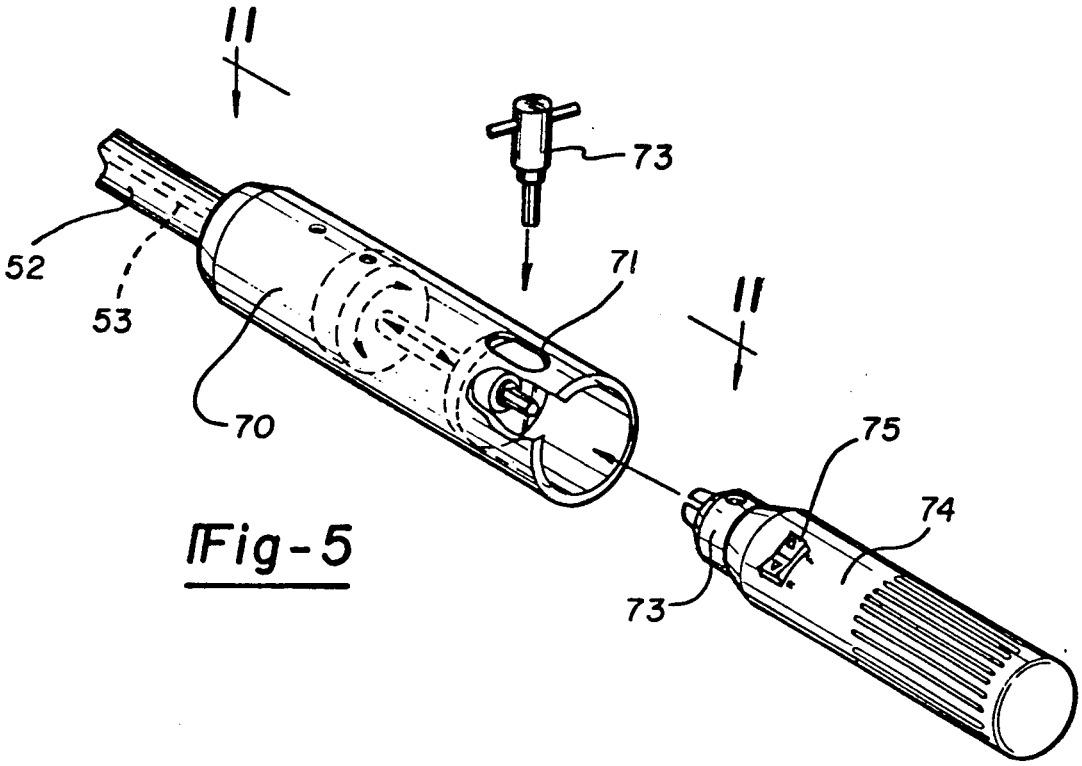
FIG. 5 is a diagrammatic view showing one embodiment of the adjustment means used in the present invention.

Referring now to FIG. 5, where the maintenance personnel of a store have a number of lighting fixtures to adjust, it will be more economical and less tiring for the maintenance personnel to have a power driving means to rotate at least the inner driving portion 53 of the wand 50. In this modification of my invention, the lower rotatable handle 56 is replaced by a housing 70 fixedly mounted to the lower end 52 of the wand 50. A hole 71 is provided in the housing 70 through which a key 72 is passed to tighten the chuck 73 of the driving means provided in the form of an electric motor 74. A switch 75 provided on the electric motor 74 provides that the means to drive said rotatable shaft is reversible.

Figure 10:
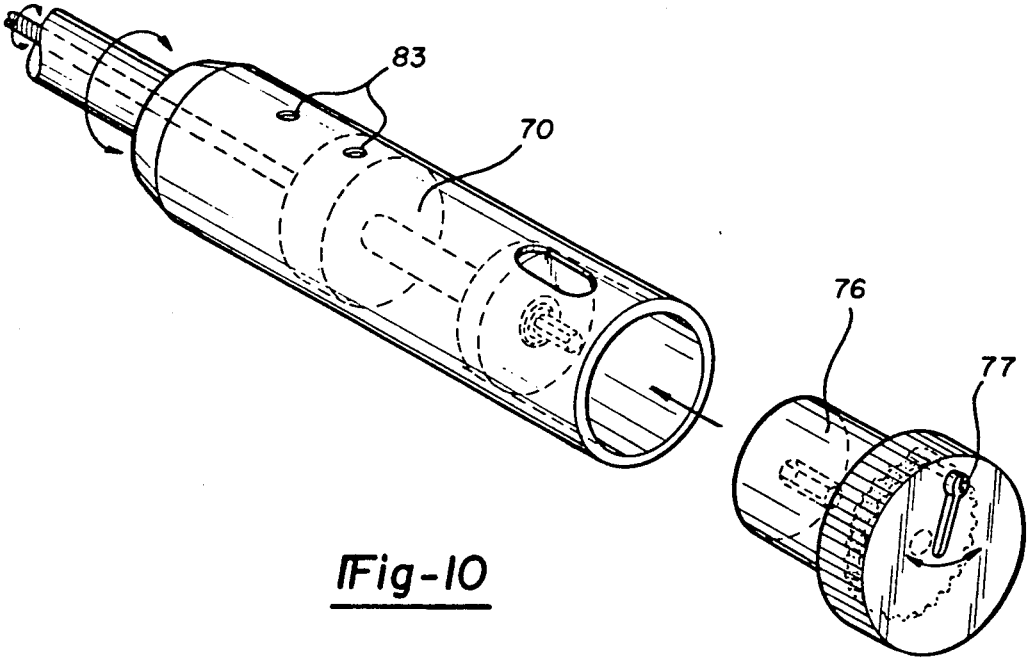
FIG. 10 is a view similar in large part to FIG. 5, but showing a manual drive means.

In FIG. 10, there is shown a modification of my invention where an electric motor 74 is not required, but a more efficient mechanical means is needed to rotate the inner driving portion 53 of the wand 50. In this case, a manual driving means 76 is inserted in the housing 70 in place of the electric motor 74, and the inner driving portion 53 of the wand is driven by ratchet means 77 well known in the art.

Figure 11:
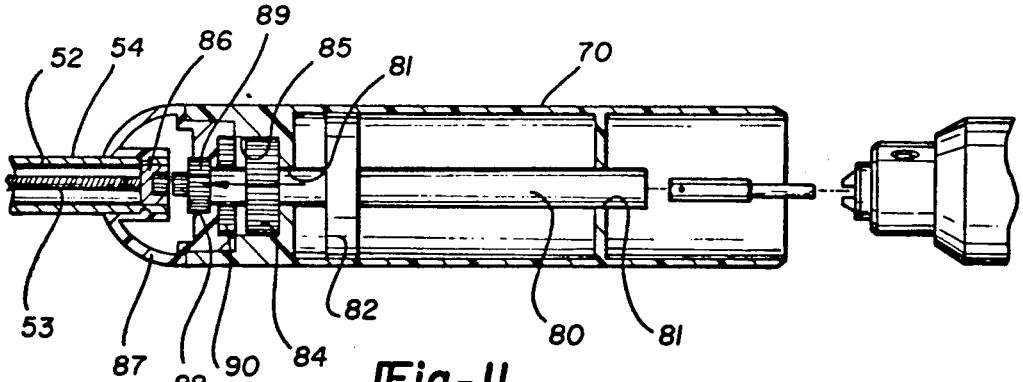
FIG. 11 is an elevational view, partly in section, and similar in large part to FIG. 5 showing the operation of an adjustment means of the present invention.
Figure 12:
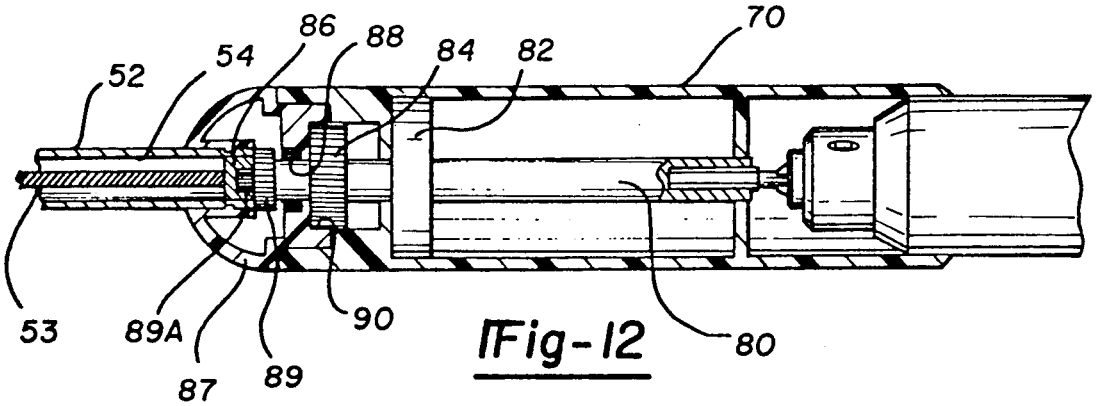
FIG. 12 is a view similar to FIG. 11 showing the rotatable shaft means shifted from its first operating position to its second operating position.

Referring now to FIGS. 11 and 12, the operation of the means to drive said rotatable shaft can be seen in more detail. The housing 70 contains a shaft 80 journaled for rotation therein by means known in the art, and shiftable between a first and second position. The shaft is shown in its first position in FIG. 11, where the means to rotate is set up to rotate the outer driving portion of the wand 50 while holding the inner driving portion stationary, and is shown in its second position in FIG. 12, where the means to rotate is set up to rotate the inner driving portion 53 while holding the outer driving portion 54 stationary.

Referring specifically to FIG. 11, the shaft 80 is journaled for rotation in the housing 70 at bearing surface 81. When shifting between its first and second positions, indicator member 82 will show through one of the holes 83 in the housing 70, as shown in FIG. 10, to indicate to the operator which position the shaft is in. In the first position, a gear 84 rotates within a cavity 85 provided in the housing 70. The lower end 52 of the wand 50 is constructed not unlike the upper end 51 thereof in that the outer driving portion 54 has journaled therewithin an internal spline 86 fixedly attached to the lower end of the inner driving portion 53 which may be flexible as shown. It should also be understood that the outer driving portion 54 which is, in turn, fixedly attached to the drive means 87 can also be flexible. Within the drive means 87 is provided a second internal spline 88 which has teeth which will mate with the second gear 89 when the same is shown in position 1 as shown in FIG. 11.

Opposite the second internal spline is a third internal spline 90 which will mate with teeth from gear 84 when the shaft 80 is in its second position shown in FIG. 12. When the means to rotate is in the position shown in FIG. 11, it can be seen that the gear 84 freely rotates in the cavity 85, while the second gear 89 engages the second internal spline 88, causing rotation of the drive means 87 which is fixedly attached to the outer driving portion 54 of the wand 50. Since there is a loose fit between the internal spline 86 and the outer driving portion 54 of the wand 50, the internal spline 86, and thus the inner driving portion 53 of the wand 50 will not turn, especially since there is some internal resistance involved.

When shifted to position 2, as shown in FIG. 12, the second gear 89 has moved forward to abut against the outer driving portion 54 on the lower end of the wand 52, and the pinion portion **89*a* of gear 89 engages the gear teeth found in the internal spline 86 to rotate the inner driving portion of the wand 50 and therefore ultimately rotate the output shaft of the gear box. Because at the same time the second gear 89 was moved to its forward position the gear 84 also was shifted to engage the third spline 90, the drive means 87 is locked to the housing 70 so that the outer driving portion 54 of the wand 50 is held stationary. Of course, it can be seen for this to occur that the gear 84 needs to be suitably attached to the shaft 80 to allow it to shift when said shaft shifts. It must also be freely rotatable about the shaft 80 so that it is not constrained to rotate with the shaft 80**.

Figure 13:
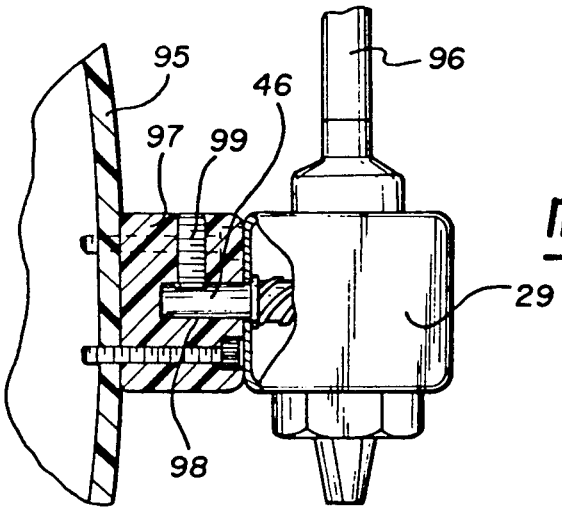
FIG. 13 is a partial elevational view, partly in section, showing a shaft-receiving means attached to an existing lighting fixture to adapt the same according to the method of the present invention to rotate and be adjustable from a remote location.
Figure 14:
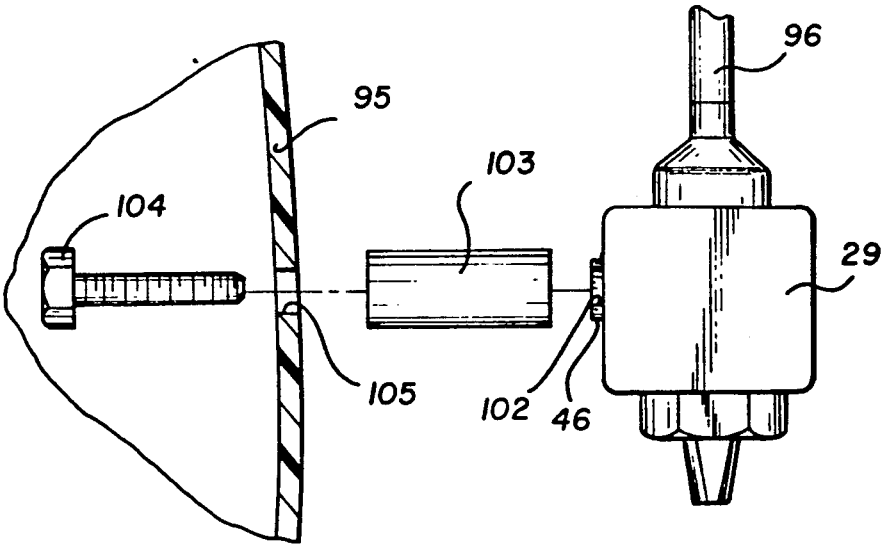
FIG. 14 is a modification of the shaft receiving means shown in FIG. 14.

In connection with developing my unique invention whereby a lighting fixture can be rotated about two different axes from a remote location by a power input about only one of said axes. I have also developed a novel method of converting existing lighting fixtures to use my apparatus. Many spotlights are offered for use in connection with track lighting or other types of lighting apparatus. Referring to FIGS. 13 and 14, many of them have a fixture housing such as indicated by the numeral 95 mountable to some sort of a fixture mounting pole 96. If the lighting fixture to be adapted is similar to that shown in FIG. 2, my method involves disconnecting the lighting fixture from the fixture mounting pole 96, attaching a power transfer means 29 of the type previously described to the bottom of the fixture mounting pole 96, attaching a shaft-receiving means 97 having a shaft-receiving hole 98 provided therein, and placing the output shaft 46 into the shaft-receiving hole 98 and tightening the set screw 99, thereby locking the light fixture to the gear box 29. Thereafter, the operation of the pre-existing lighting fixture becomes the same as my improved lighting fixture.

In some cases, the conversion shown in FIG. 14 is more convenient. In this case, the power transfer means 29 is still attached to the fixture mounting pole 96, but the output shaft 46 thereof has an internal thread 102 provided therein. A spacer 103 is provided between the fixture housing 95 and the fixture mounting pole 96, and a bolt 104 or other suitable means is placed through the hole 105 and the spacer 103 into the internally threaded portion 102 of the output shaft 46 of the power transfer means 29.

If the fixture mounting pole is not sufficiently similar to the one illustrated in FIG. 1, it may be necessary to replace the old fixture mounting pole with a new fixture mounting pole having a power transfer means mounted on the lower end thereof, and then attaching the shaft-receiving means to the lighting fixture, and connecting the output shaft of the power transfer means to the shaft-receiving means to accomplish my conversion.

In some cases, the spotlights, instead of having a single point of connection between the lighting fixture and the pole, have a yoke-type mounting arrangement, and if this type of lighting fixture is to be converted, it is necessary to disconnect the lighting fixture entirely from the fixture mounting pole, discarding the yoke and interposing between the portion of the fixture mounting pole remaining and the lighting fixture a power transfer means 29 of the type previously described in order to accomplish the method of the present invention. By either simply mounting a gear box to the lower end of a fixture mounting pole, replacing the fixture mounting pole with a fixture mounting pole of the type described, or interposing a power transfer means such as a gear box, it is believed that a majority of the lighting fixtures may be converted, using my method, to light fixtures adjustable in accordance with the present invention, thus saving thousands of dollars in many instances over the cost of providing entirely new light fixtures operating according to the present invention.

Referring now to FIG. 15, there is shown a modification of the present invention wherein the power transfer means 29 is mounted at the upper end of the wand 50 instead of on the lower end of the fixture mounting pole 23. In this modification, the output from the power output means 29 is transferred to a male connector 107 which fits into a female connector 108 which is fixedly connected to fixture housing 109 to rotate the same upon rotation of the inner driving portion 53 (not shown) of the wand 50. Rotation of the outer driving portion 54 of the wand 50 will cause the fixture housing 109 and/or the fixture mounting pole 23 to rotate. As before, the power transfer means and may be integral with, or attached to, the end of the wand 50.

Figure 16:
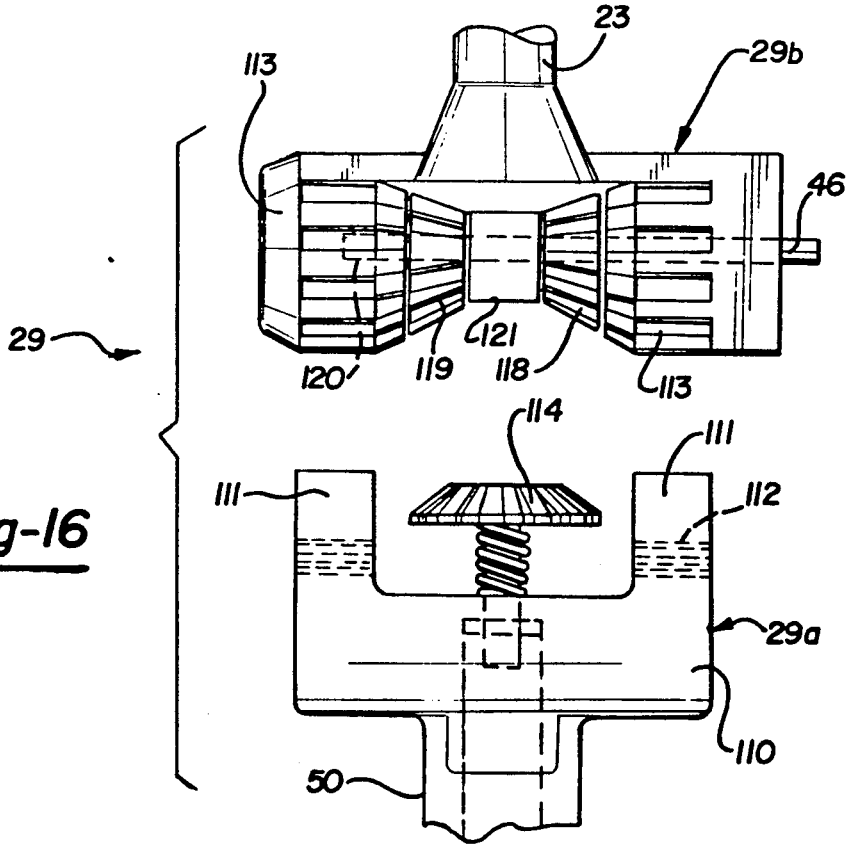
FIG. 16 is an elevational view showing a further modification of the invention where a portion of the power transfer means are placed at the end of the fixture mounting pole and a portion of the power transfer means are placed at the end of the hollow adjustment wand.
Figure 18:
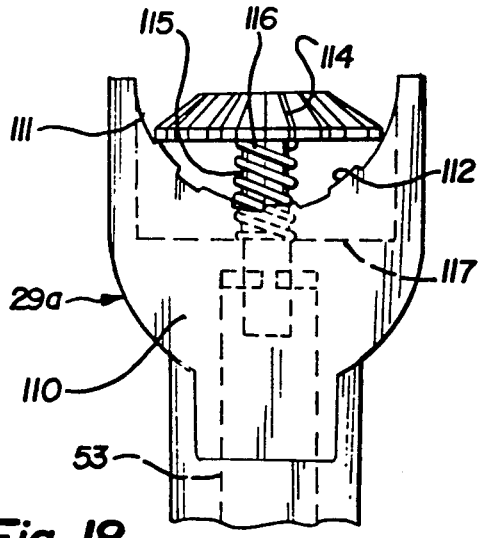
FIG. 18 is an end view of the top portion of the hollow adjustment wand shown in FIG. 17.

Referring now to FIGS. 16–18, there is shown the most preferred embodiment of the present invention. In this embodiment, the power transfer means 29 is split into more than one part, in this specific instance, two parts, so that the power transfer means 29 has a power input portion 29A and a power output portion 29B. The power input portion 29A of the power transfer means 29 is mounted to, or integral with, the upper end of the wand 50, while the power output portion 29B is mounted to, or integral with, the lower end of the fixture mounting pole 23. The power input portion 29A of the power transfer means 29 further includes a bifurcated member 110 having a pair of identical cradles 111 at each end thereof. Each cradle has a series of axially spaced ribs 112 which mate with corresponding recesses in the cradle receiver 113 of the power output portion 29B.

Mounted for rotation between the cradles 111 is a bevel gear 114. The bevel gear 114 is mounted to the upper end of stub shaft 115 and spring loaded by the spring 116 which abutts against the floor 117 of the power input portion 29A. The lower end of the stub shaft 115 is splined or otherwise restrained for rotation and reciprocation by means well known in the art to the upper end of the inner driving portion 53 of the wand 50. As before, the bifurcated member 110 may be mounted to or integral with the wand 50.

The power output portion 29B of the power transfer means includes the cradle receiver 113 which is complementary in shape to at least a portion of the bifurcated member 110 to receive the ribs 112 which are radially spaced in the cradles 111. The bevel gear 114 drives a second bevel gear 118 attached to output shaft 46. Bevel gear 114 also drives an idler gear 119 mounted for rotation to idler shaft 120, which is supported, in part by bushing 121. Thus, when the power input portion 29A of the power transfer means 29 is moved into the engagement with the power output portion 29B, the bevel gear 114 engages second bevel gear 118 to rotate output shaft 46 when the inner driving portion 53 of the wand 50 is rotated, thereby rotating the luminaire 120 about said second axis of rotation.

Rotation of the outer driving portion 54 of the wand 50 rotates the luminaire 120 abount a said first axis of rotation by virture of the rotation of the fixture mounting pole 23. As with the other modifications of the present invention previously described, the power output portion 29B of the power transfer means may be integral with the fixture mounting pole 23 as shown in FIG. 17, in which case the fixture mounting pole 23 will be rotatably mounted in the track head 22. Depending on the application, in some installations, the fixture mounting pole 23 may be fixedly mounted to the track head 22 in which case, the power output portion 29B will not be integral with the fixture mounting pole 23, but instead, will rotate with respect thereto. As before, the fixture mounting pole may also be mounted directly to a canopy (not shown) instead of a track head.

Thus, by carefully analyzing the longstanding problems in the lighting art, and determining that by providing a gear box or other power transfer means between the common fixture mounting pole and the lighting fixture itself, rotation about a first and second axis of rotation could be achieved from a remote location, by providing a power input to the power transfer means about only one of said axes. I have provided a novel and more efficient lighting system providing for more efficient adjustment of any luminaire used in the system.

I claim:

1. A lighting system including, in combination:

(a) a power transfer means having a single axis of power input and two axes of power output, one of said two axes of power output being coaxial with said single axis of power input, and (b) a light source connected to said power transfer means for rotation about each of said two axes of power output in response to a rotation of a power input means about said single axis of said power input.

2. In an adjustable lighting system:

(a) a power transfer means having power input means arranged about a first axis of rotation, and power output means arranged along said first axis of rotation and a second axis of rotation, and (b) a light source connected to said power transfer means to rotate about said first and said second axes of rotation in response to rotational power input to said power transfer means about said first axis of rotation only.

3. The lighting system defined in claim 2, wherein said power input to said power transfer means is a rotational force about a vertical axis of rotation.

4. The lighting system defined in claim 2, wherein said power input to said power transfer means is a rotational force about a horizontal axis of rotation.

5. An adjustable lighting system including, in combination:

(a) a power transfer means having a rotational power input about a vertical axis of rotation, and (b) a light source connected to said power transfer means for rotation about said vertical axis of rotation and an intersecting horizontal axis of rotation in response to said rotational power input to said power transfer means about said vertical axis of rotation only.

6. An adjustable lighting system including, in combination:

a) a fixture mounting pole, b) a single power transfer means having input means and output means, at least a portion of said power transfer means being connected to said fixture mounting pole, and;

c) a light source connected to said output means of said power transfer means to rotate about a first axis in response to the physical rotation of said power transfer means about said first axis, and about a second axis in response to rotation of said input means about said first axis.

7. The lighting system defined in claim 6, and further including:

a) an adjustment means removably connectable to said single power transfer means to operate said power input means and thereby rotate said power output means and said light source.

8. The lighting fixture defined in claim 7, wherein said power transfer means is a gearbox.

9. The lighting system defined in claim 6, and further including:

a) an adjustment means, said adjustment means incluiding said input means of said single power transfer means and being connectable to said output means of said power transfer means to rotate said lamp holder about said first axis in response to physical rotation of said power transfer means and to rotate said light source about said second axis by rotation of said output means, when desired.

10. The lighting system defined in claim 9, wherein said adjustment means further includes:

a) a wand removably connectable at its upper end to said power output portion of said power transfer means.

11. The lighting system defined in claim 10, wherein said wand further includes:

a) a bifurcated member at the upper end of said wand, said bifurcated member having a cradle at either end thereof, each of said cradles having a plurality of radially spaced ribs provided thereon.

12. The lighting system defined in claim 11, wherein said wand further includes:

a) an inner driving portion having a bevel gear mounted at the upper end thereof, and;

b) an outer driving portion fixedly connected to said bifurcated member.

13. The lighting system defined in claim 12, wherein said beveled gear is spring loaded and mounted for reciprocating movement to one end of said inner driving portion of said wand.

14. The lighting system defined in claim 13, wherein said power output portion of said power transfer means includes:

a) a cradle receiving means complementary in shape to said cradles of said bifurcated member, b) a second bevel gear drivingly engagable with said bevel gear, and;

c) a power output shaft connected to said second beveled gear.

15. The lighting system defined in claim 14, wherein said power output portion of said power transfer means further includes:

a) an idler shaft coaxial with said output shaft, b) an idler gear for engagement with said first beveled gear.

16. The lighting system defined in claim 15, wherein said power output means of said power transfer means is integral with said fixture mounting pole.

17. The lighting fixture defined in claim 6, wherein said power transfer means is a gearbox.

18. An adjustable lighting system including, in combination:

(a) a track head mountable to a lighting track, (b) a fixture mounting pole connected to said track head, (c) a power transfer means including a housing, an input shaft and an output shaft, each of said input shaft and said output shaft having an axis, said housing connected to a lower end of said fixture mounting pole, said output shaft rotatable about said output shaft axis in response to rotation of said input shaft, and said fixture mounting pole rotatable in response to rotation of said housing, and (d) a lamp holder connected to said output shaft of said power transfer means to rotate about said input shaft axis in response to the rotation of said housing, and about said output shaft axis in response to the rotation of said input shaft, said lamp holder capable of holding a lamp which is electrically connected to said track.

19. The lighting system defined in claim 18, and further including:

a) an adjustment means connectable to said input shaft of said power transfer means to rotate the output shaft thereof, and thereby rotate said lamp holder about said output shaft axis when desired, and to said housing of said power transfer means to physically rotate said housing, and thereby rotate said fixture mounting pole about said input shaft axis when desired, thus providing for the rotation of said lamp holder about two different axes from a remote location.

20. The lighting system defined in claim 19, wherein said adjustment means further includes:

a) a wand removably connectable at its upper end to said housing and to said input shaft of said power transfer means.

21. The lighting system defined in claim 20, wherein said wand further includes:

a) an inner driving portion connectable to said input shaft of said power transfer means, and b) an outer driving portion connectable to said housing for bodily rotation of thereof.

22. The system defined in claim 21, wherein said wand further includes:

a) a first grip fixedly mounted to said outer driving portion, and b) a second grip fixedly mounted to said inner driving portion.

23. The lighting system defined in claim 20, and further including:

a) power driving means removably connectable to a lower end of said wand for power assisted rotation of said lamp holder about two different axis.

24. The system defined in claim 23, wherein said power driving means is replaceable by a ratchet type manual driving means.

25. The system defined in claim 23, wherein said power driving means includes:

a) a second housing, b) a rotatable shaft carried by said second housing and being shiftable between a first and a second position such that when in its first position it rotates said inner driving portion of said wand, thereby rotating said input shaft of said power transfer means to rotate said lamp holder about said output shaft axis, and when in its second position it rotates said power transfer means housing, and thereby rotates said lamp holder about said input shaft axis, and c) means to drive said rotatable shaft.

26. The system defined in claim 25, wherein said means to drive said rotatable shaft further include:

a) an electric motor removably connectable to a lower end of said rotatable shaft and shiftable in position therewith.

27. The system defined in claim 26, wherein said electric motor is reversible.

28. The system defined in claim 25, wherein said means to drive said rotatable shaft further include:

a) a recess provided in a lower end of said inner driving portion, b) an adapted shaft snap fit into said recess.

c) an electric motor connected to said adapter shaft for rotation.

29. The system defined in claim 20, and further including:

a) a male connector provided at a lower end of said input shaft, and b) a male connector portion provided on said housing.

30. The system defined in claim 29, wherein the upper end of said wand includes:

a) a female connector connectable to said male connector provided on said input shaft, and b) a female connector portion connectable to said male connector portion of said housing.

31. The system defined in claim 30, wherein said wand further includes:

a) an inner driving portion connected to said female connector for rotation thereof, and b) an outer driving portion connected to said female connector portion for rotation thereof.

32. The system defined in claim 31, wherein said inner driving portion is a flexible cable.

33. The system defined in claim 32, wherein said outer driving portion is flexible.

34. The system defined in claim 20, and further including:

a) a female connector provided on a lower end of said input shaft, and b) a male connector portion provided on said housing.

35. The system defined in claim 34, wherein the upper end of said wand further includes:

a) a male connector connectable to said female connector provided on said input shaft, and b) a female connector connectable to said male connector portion provided on said housing.

36. The system defined in claim 35, wherein said wand further includes:

a) an inner driving portion connected to said male connector for rotation thereof, and b) an outer driving portion connected to said female connector portion for rotation thereof.

37. The system defined in claim 36, wherein said inner driving portion is a flexible cable.

38. The system defined in claim 37, wherein said outer driving portion is flexible.

39. The system defined in claim 35, wherein said male connector is spring loaded.

40. The system defined in claim 18, and further including:

a) tension adjustment means interposed between said track head and said system mounting pole.

41. The lighting fixture defined in claim 18, wherein said power transfer means is a gearbox.

42. An adjustable lighting system including, in combination:

(a) a track head mountable to a lighting track, (b) a fixture mounting pole fixedly mounted to said track head, (c) a power transfer means including a housing rotatably mounted to said fixture pole, an input shaft and an output shaft, each of said input shaft and said output shaft having an axis, said housing mounted to a lower end of said fixture mounting pole, said output shaft rotatable about said output shaft axis in response to rotation of said input shaft, and said housing rotatable about said input shaft axis in reponse to the application of a rotational force thereto, and (d) a light source connected to said output shaft of said power transfer means to rotate about said output shaft axis in response to the rotation of said input shaft, and about said input shaft axis in response to the rotation of said housing.

43. The lighting fixture defined in claim 42, wherein said power transfer means is a gearbox.

44. A method of converting a conventional track light of a type having a track head mountable to a lighting track, and a fixture mounting pole connected at its upper end to said track head, and at its lower end to a lighting fixture having a lamp holder, to a track light wherein said lamp holder can be rotated about two intersecting axis from a remote location, said method including the steps of:

a) disconnnecting said lighting fixture from said fixture mounting pole, b) attaching a power transfer means to the lower end of said fixture mounting pole of a type having an output shaft rotatable in response to rotation of an input shaft and a housing fixedly connected to said fixture mounting pole, c) attaching a shaft receiving means to said lighting fixture to receive said output shaft of said power transfer means, d) connecting said output shaft to said shaft receiving means, and e) providing an adjustment means connectable to said input shaft of said power transfer means to rotate the same, and thereby rotate said lighting fixture about a first axis when desired, and to said housing of said power transfer means to rotate said fixture pole when desired, thereby rotating said lighting fixture about a second axis when desired.

45. The method defined in claim 44, wherein said power transfer means is a gearbox.

46. The method defined in claim 44, wherein the step of attaching a shaft receiving means to said lighting fixture includes the additional steps of:

a) attaching a mounting block having a shaft receiving hole and set screw means to said lighting fixture, b) inserting said output shaft of said power transfer means in said shaft receiving hole, and c) tightening said set screw means.

47. The method defined in claim 44, wherein the step of attaching a shaft receiving means to said lighting fixture includes the additional steps of:

a) providing that said output shaft of said power transfer means has an internal thread, b) providing a hole in said lighting fixture opposite said output shaft, or using an existing hole, c) inserting a spacer between said lighting fixture and said output shaft, and d) inserting a bolt through said hole in said lighting fixture and said spacer into said internal thread and tightening the same.

48. A method of converting a conventional track light of a type having a track head mountable to a lighting track, and a fixture mounting pole connected at its upper end to said track head, and at its lower end to a lighting fixture, to a track light wherein said lighting fixture can be rotated about two intersecting axis from a remote location, said method including the steps of:

a) disconnecting said lighting fixture from said fixture mounting pole, b) replacing said fixture mounting pole with a new fixture mounting pole of a type having a power transfer means on a lower end of said fixture mounting pole of a type having an output shaft rotatable in response to rotation of an input shaft and its housing connected to said fixture mounting pole, c) attaching a shaft receiving means to said lighting fixture to receive said output shaft of said power transfer means, d) connecting said output shaft to said shaft receiving means, and e) providing an adjustment means connectable to said input shaft of said power transfer means to rotate the same, and thereby rotate said lighting fixture about a first axis when desired, and to said housing of said power transfer means to rotate said fixture pole when desired, thereby rotating said lighting fixture about a second axis when desired.

49. The method defined in claim 48, wherein said power transfer means is a gearbox.

50. The method defined in claim 48, wherein the step of attaching a shaft receiving means to said lighting fixture includes the additional steps of:

a) providing that said output shaft of said power transfer means has an internal thread, b) providing a hole in said lighting fixture opposite said output shaft, or using an existing hole, c) inserting a spacer between said lighting fixture and said output shaft, and d) inserting a bolt through said hole in said lighting fixture and said spacer into said internal thread and tightening the same.

51. The method defined in claim 48, wherein the step of attaching a shaft receiving means to said lighting fixture includes the additional steps of:

a) attaching a mounting block having a shaft receiving hole and set screw means to said lighting fixture, b) inserting said output shaft of said power transfer means in said shaft receiving hole, and c) tightening said set screw means.

52. A method of converting a conventional track light of a type having a track head mountable to a lighting track, and a fixture mounting pole connected at its upper end to said track head, and at its lower end to a lighting fixture, to a track light wherein said lighting fixture can be rotated about two intersecting axis from a remote location, said method including the steps of:

a) disconnecting said lighting fixture from said fixture mounting pole, b) providing at a point of connection between said lighting fixture and said fixture mounting pole a power transfer means of a type having an output shaft rotatable in response to a rotation of an input shaft and having a housing connected to said fixture mounting pole, c) attaching a shaft receiving means to said lighting fixture to receive said output shaft of said power transfer means, d) connecting said output shaft to said shaft receiving means, and e) providing an adjustment means connectable to said input shaft of said power transfer means to rotate the same, and thereby rotate said lighting fixture in a first plane when desired, and to said housing of said power transfer means to rotate said fixture pole when desired, thereby rotating said lighting fixture in a second plane when desired.

53. The method defined in claim 52, wherein said power transfer means is a gearbox.

54. The method defined in claim 52, wherein the step of attaching a shaft receiving means to said lighting fixture includes the additional steps of:

a) attaching a mounting block having a shaft receiving hole and set screw means to said lighting fixture, b) inserting said output shaft of said power transfer means in said shaft receiving hole, and c) tightening said set screw means.

55. The method defined in claim 52, wherein the step of attaching a shaft receiving means to said lighting fixture includes the additional steps of:

a) providing that said output shaft of said power transfer means has an internal thread, b) providing a hole in said lighting fixture opposite said output shaft, or using an existing hole, c) inserting a spacer between said lighting fixture and said output shaft, and d) inserting a bolt through said hole in said lighting fixture and said spacer into said internal thread and tightening the same.

* * * * *